US006732613B2

(12) United States Patent
Hsieh

(10) Patent No.: US 6,732,613 B2
(45) Date of Patent: May 11, 2004

(54) SCREWDRIVER WITH CHANGEABLE OPERATION MODES

(76) Inventor: Chih-Ching Hsieh, No. 367-1, Pei Yang Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 10/244,024

(22) Filed: Sep. 16, 2002

(65) Prior Publication Data

US 2004/0050215 A1 Mar. 18, 2004

(51) Int. Cl.[7] ..... B25B 13/00
(52) U.S. Cl. ..... 81/58.3; 81/29
(58) Field of Search ..... 81/58.3, 60, 63.1, 81/29, 450; 192/43

(56) References Cited

U.S. PATENT DOCUMENTS 2,443,339 A * 6/1948 Blalock ..... 81/28
2,667,801 A * 2/1954 Eaves ..... 81/58.3
3,127,797 A * 4/1964 Rogers ..... 81/58.3
3,827,470 A * 8/1974 Douglas et al. ..... 81/29
3,958,469 A * 5/1976 Meese ..... 81/58.3
4,341,292 A * 7/1982 Acevedo ..... 192/43
4,341,293 A * 7/1982 Acevedo ..... 192/43
5,211,086 A * 5/1993 Shu ..... 81/58.1
6,622,597 B2 * 9/2003 Chen ..... 81/58.3

* cited by examiner

*Primary Examiner*—Joseph J. Hail, III
*Assistant Examiner*—David B. Thomas
(74) *Attorney, Agent, or Firm*—Troxell Law Office PLLC

(57) ABSTRACT

Screwdriver with changeable operation modes, including: a handle having a slide way formed in the handle and passing through a front end of the handle; a stem, a rear end of which is slidably fitted in the slide way without detaching from the handle; a clutch mechanism connected between the stem and the handle, in normal state, the clutch mechanism being in a non-transmission state, whereby the stem can freely rotate within the handle; and a rotary member connected with the stem for a user's hand to rotate. When the screwdriver is used to screw a screw in a loosened state, the user can turn the rotary member to rotate the stem. In the case that the screw is in a tightened state, the handle is pressed to move the stem inward, the clutch mechanism is in a transmission state and the user can turn the handle to drive the stem.

19 Claims, 8 Drawing Sheets

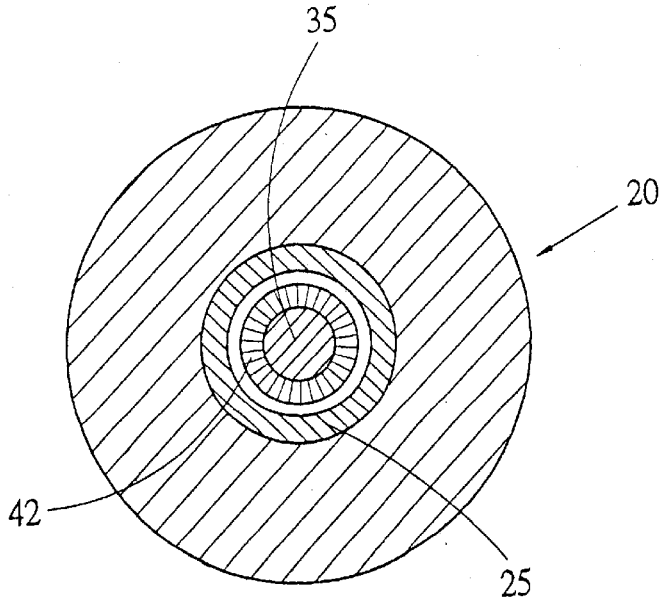
Fig. 3
Replacement Sheet

SCREWDRIVER WITH CHANGEABLE OPERATION MODES

BACKGROUND OF THE INVENTION

The present invention is related to a hand tool, and more particularly to a screwdriver with changeable operation modes. In accordance with the loosened and tightened states of the screw, the operation modes of the screwdriver can be changed.

A conventional screwdriver has a stem and a handle on which the stem is directly fixedly connected. When a user operates such screwdriver for screwing a screw, the user's hand must repeatedly hold and release to rotate the screwdriver. This is inconvenient for the user. A ratchet screwdriver has been developed, wherein a ratchet mechanism is connected between a handle and a stem. When turning the handle in one direction, via the ratchet mechanism, the stem is synchronously rotated. When turning the handle in another direction, the handle idles without driving the stem. Accordingly, by means of reciprocally rotating the handle, the screw is one-way screwed. This is more convenient for a user to operate the screwdriver.

However, it is known that when screwing a screw with a ratchet screwdriver, the ratchet screwdriver fails to provide ratchet effect during the entire operation. This is because that during the screwing operation, no matter whether screwing or unscrewing the screw, there are two states, that is, loosening and tightening states. Only when the screw is in a tightened state to a certain extent, the ratchet screwdriver can provide ratchet effect. That is, only when the stem suffers a certain resistance, the ratchet mechanism can effectively work to provide ratchet effect. (that is, when the handle is turned in one direction, the handle idles without driving the stem, while when the handle is turned in another direction, the stem is driven.)

When the screw is in a loosened state, the resistance against the stem is insufficient to activate the ratchet mechanism. Under such circumstance, the ratchet screwdriver loses its ratchet effect, and it's no different from a conventional screwdriver in operation. Therefore, the conventional ratchet screwdriver is still imperfect.

SUMMARY OF THE INVENTION

It is therefore a primary object of the present invention to provide a screwdriver with changeable operation modes. In accordance with the loosened and tightened states of the screw, the operation modes of the screwdriver can be changed. When the screwdriver is used to screw a screw in a loosened state, without turning the handle, a user can directly turn the stem to screw a screw. In the case that the screw is in a certain tightened state, the user can turn the handle to drive the stem.

The present invention can be best understood through the following description and accompanying drawings wherein:

BRIEF DESCRIPTION OF THE DRAWINGS

FIG. 3 is a sectional view taken along line 3—3 of FIG. 2;

DETAILED DESCRIPTION OF THE PREFERRED EMBODIMENTS

Figure 1:
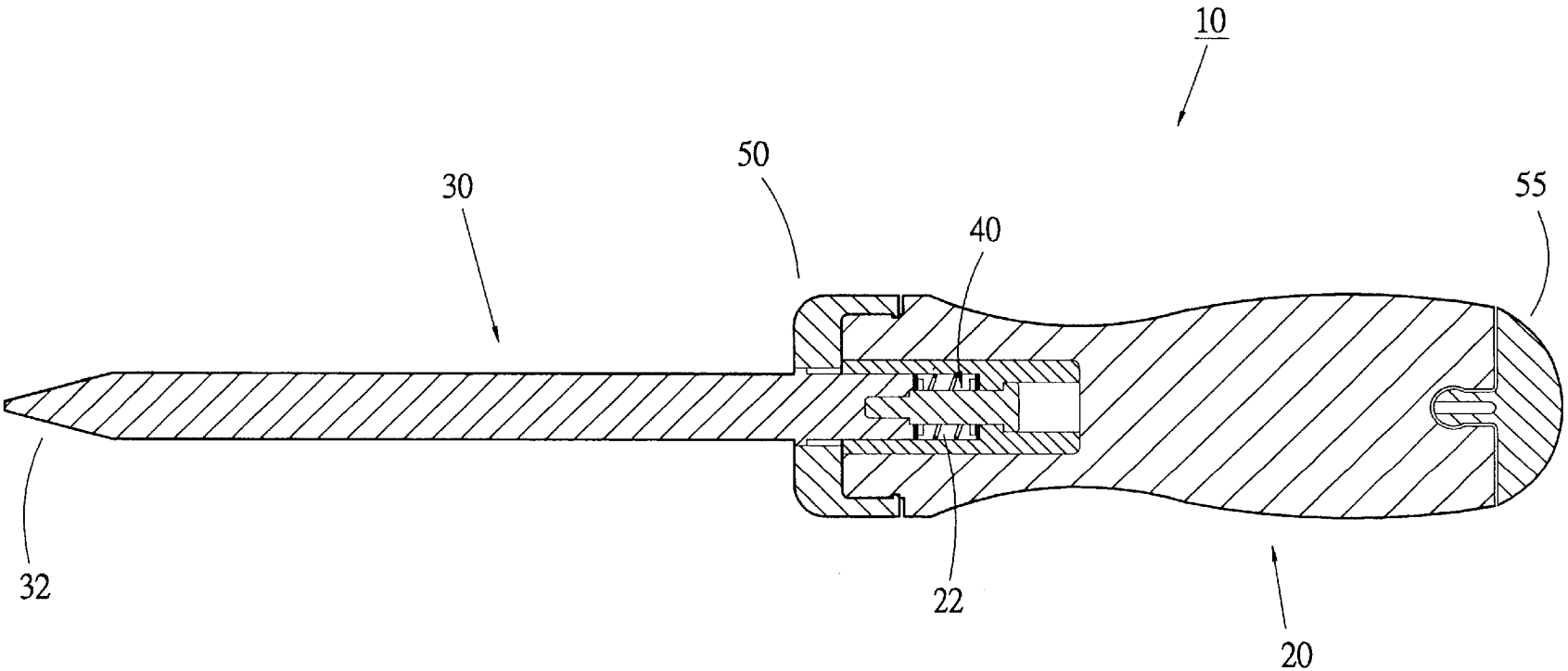
FIG. 1 is a longitudinal sectional view of a preferred embodiment of the present invention.
Figure 2:
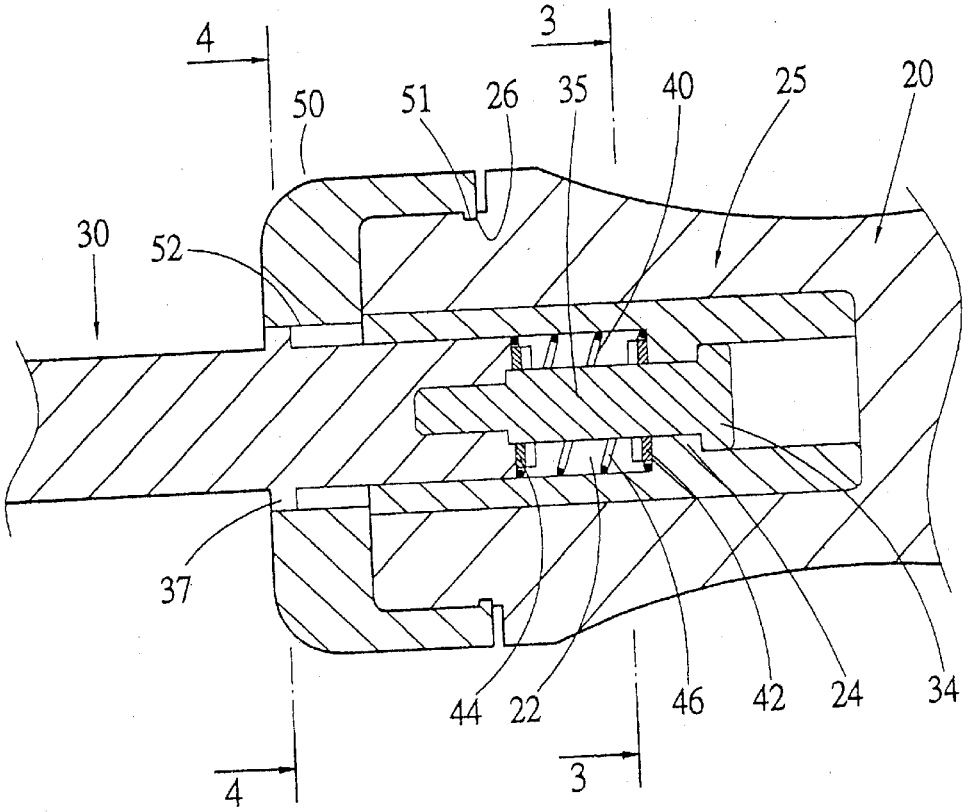
FIG. 2 is an enlarged view of a part of FIG. 1.

Please refer to FIGS. 1 and 2. According to a first embodiment, the screwdriver 10 of the present invention includes a handle 20, a stem 30, a clutch mechanism 40 and a rotary member 50.

The rear end of the stem 30 is undetachably and slidably fitted in the handle 20.

The clutch mechanism 40 is connected between the stem 30 and the handle 20. In normal state, the clutch mechanism is kept in a non-transmission state, whereby the handle cannot drive the stem and the stem can freely rotate within the handle. Reversely, when the stem is moved into the handle, the clutch mechanism is in a transmission state, whereby the handle can drive the stem.

The rotary member 50 is connected with the stem 30 for rotating the stem.

When a screw is in a loosened state and in the case that the clutch mechanism 4 is not engaged, the rotary member 50 is manually rotated to make the stem 30 screw the screw. When a screw is in a tightened state and the clutch mechanism is engaged, the handle 20 can rotate the stem with higher tightening force.

The structure of the present invention will be de scribed in detail herebelow.

The handle 20 has an axial internal slide way 22 passing through the front end of the handle. In practice, in the case that the handle is made of plastics, a hard tubular m ember 25 is embedded in the handle. The interior of the tubular member forms the slide way 22 and the strength of the handle is increased. The tubular member is omissible.

The front end of the stem 30 is a screwdriver bit 32 for connecting a screw. The rear end of the stem is fitted in the slide way 22 and slidable along the slide way without detaching therefrom. In order to prevent the stem from detaching from the slide way, in this embodiment, the stem 30 has a stop portion 34 which is stoppable by an annular locating section 24 formed on inner face of the wall of the slide way. The stop portion 34 can be integrally formed on the stem. In this embodiment, the stem further includes a restricting member 35. The front end of the restricting member is fixedly connected with rear end of the stem by way of tight fit or screwing. The stop portion 34 is formed at rear end of the restricting member 35.

The clutch mechanism 40 is disposed in the slide way 22, having a first toothed body 42, a second toothed body 44 and a resilient member 46. As shown in FIG. 3, the toothed bodies 42, 44 are annular bodies. One end face of each toothed body is formed with multiple annularly arranged teeth. The first toothed body 42 is integrally formed in the slide way 22 or fixedly connected in the slide way 22 without displacement. In this embodiment, the toothed body 42 is fixedly disposed at front end of the locating section 24. Similarly, the second toothed body 44 is integrally formed at rear end of the stem 30 or fixedly connected therewith and is movable along with the stem. The teeth of the toothed bodies face each other. One end of the resilient member 46 is located in the slide way 22. For example, the end of the resilient member 46 can abut against the locating section 24. The other end of the resilient member 46 abuts against the rear end of the stem 30. In normal state, the stem is pushed outward by the resilient member 46, making the two toothed bodies 42, 44 disengaged from each other.

Figure 4:
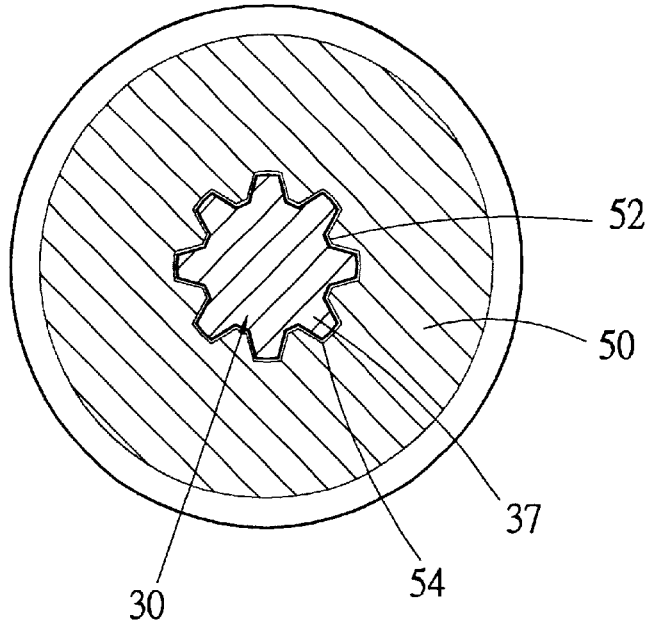
FIG. 4 is a sectional view taken along line 4—4 of FIG. 3, showing that the stem is engaged with the rotary member.
Figure 5:
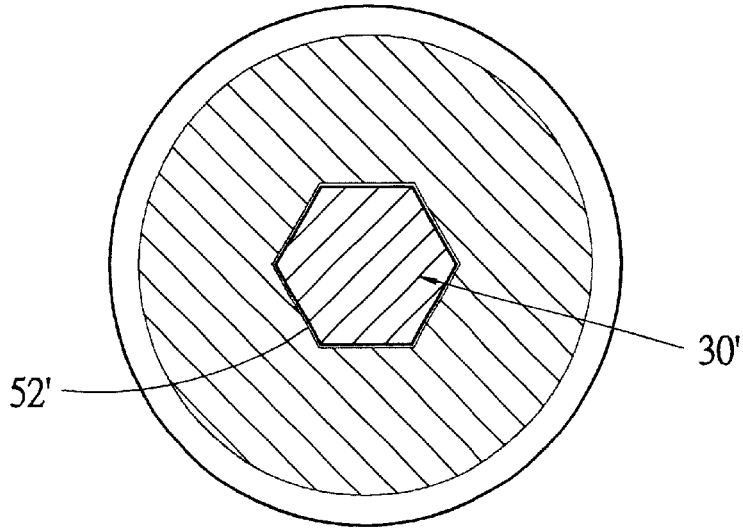
FIG. 5 shows another aspect of the engagement between the stem and the rotary member.

In this embodiment, the rotary member 50 is a fitting ring having an insertion section 51 rotatably latched in an annular groove 26 of front end of the handle 20. The rotary member 50 is formed with a central engaging hole 52 through which the stem 30 slidably extends. As shown in FIG. 4, the stem is engaged in the engaging hole. The body of the stem is formed with several projecting sections 37, while the circumference of the engaging hole 52 is formed with several dents 54 for engaging with the projecting sections 37, whereby the rotary member 50 can drive the stem 30 to rotate. Alternatively, as shown in FIG. 5, the cross-sections of the stem 30' and the engaging hole 52' can be polygonal to form an engaging structure.

With respect to loosened and tightened states of a screw, the screwdriver of the present invention can have different operation ways.

Figure 6:
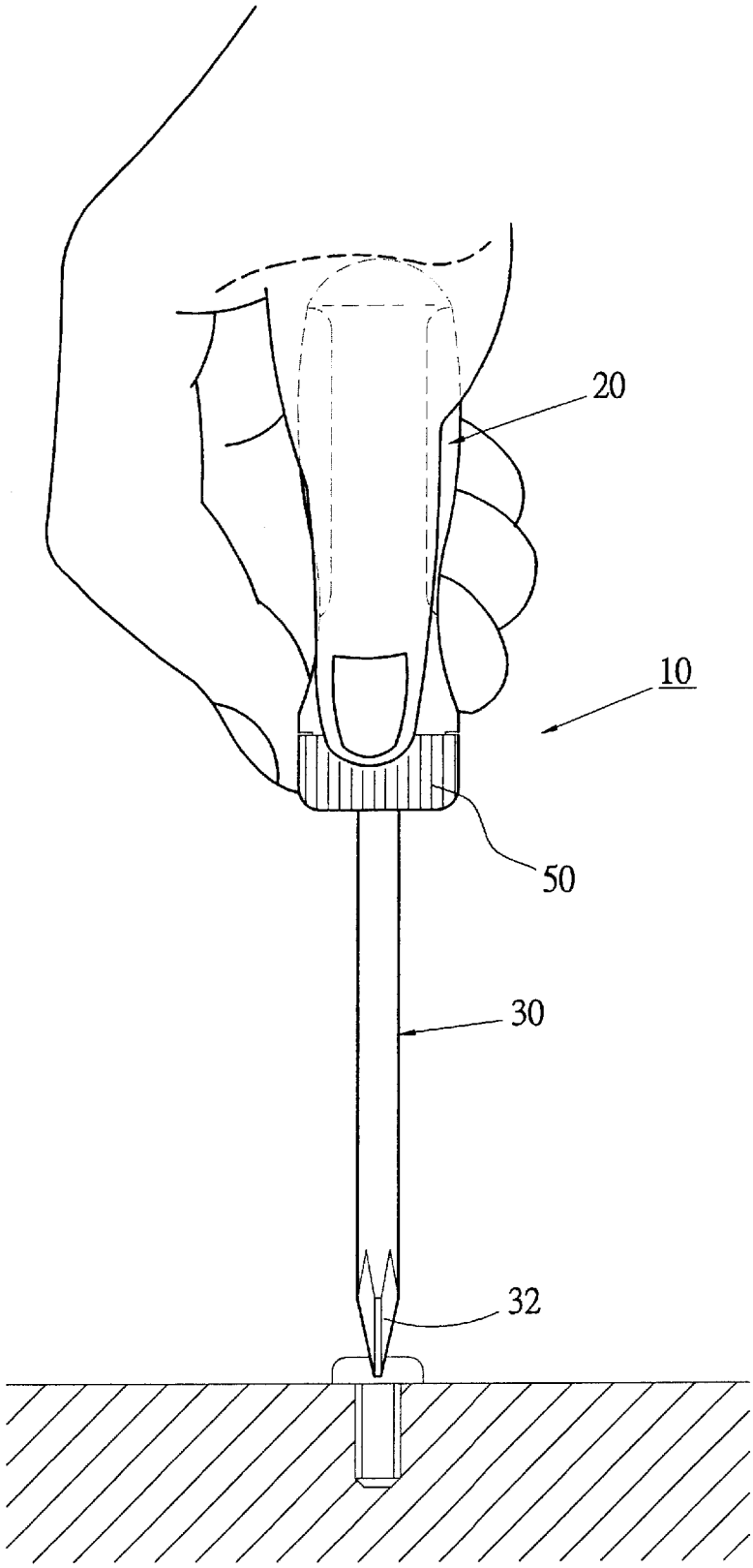
FIG. 6 shows the use of the present invention in a state of FIG. 1.

In normal state as shown in FIGS. 1 and 2, the clutch mechanism 40 of the screwdriver 10 is in a disengaged state, that is, the two toothed bodies 42, 44 are disengaged from each other so that the clutch mechanism will not provide transmission effect. Under such circumstance, the stem 30 is freely rotatable within the slide way 22. At this time, the screwdriver is suitable for screwing a screw in loosened state. As shown in FIG. 6, a user can hold the handle 20 and turn the rotary member 50 with finger(s). Through the rotary member, the stem 30 is rotated to screw the screw. The resistance of the screw is little so that by means of turning the rotary member, the loosened screw can be screwed without turning the handle. Therefore, the operation can b e quickly and easily performed.

Figure 7:
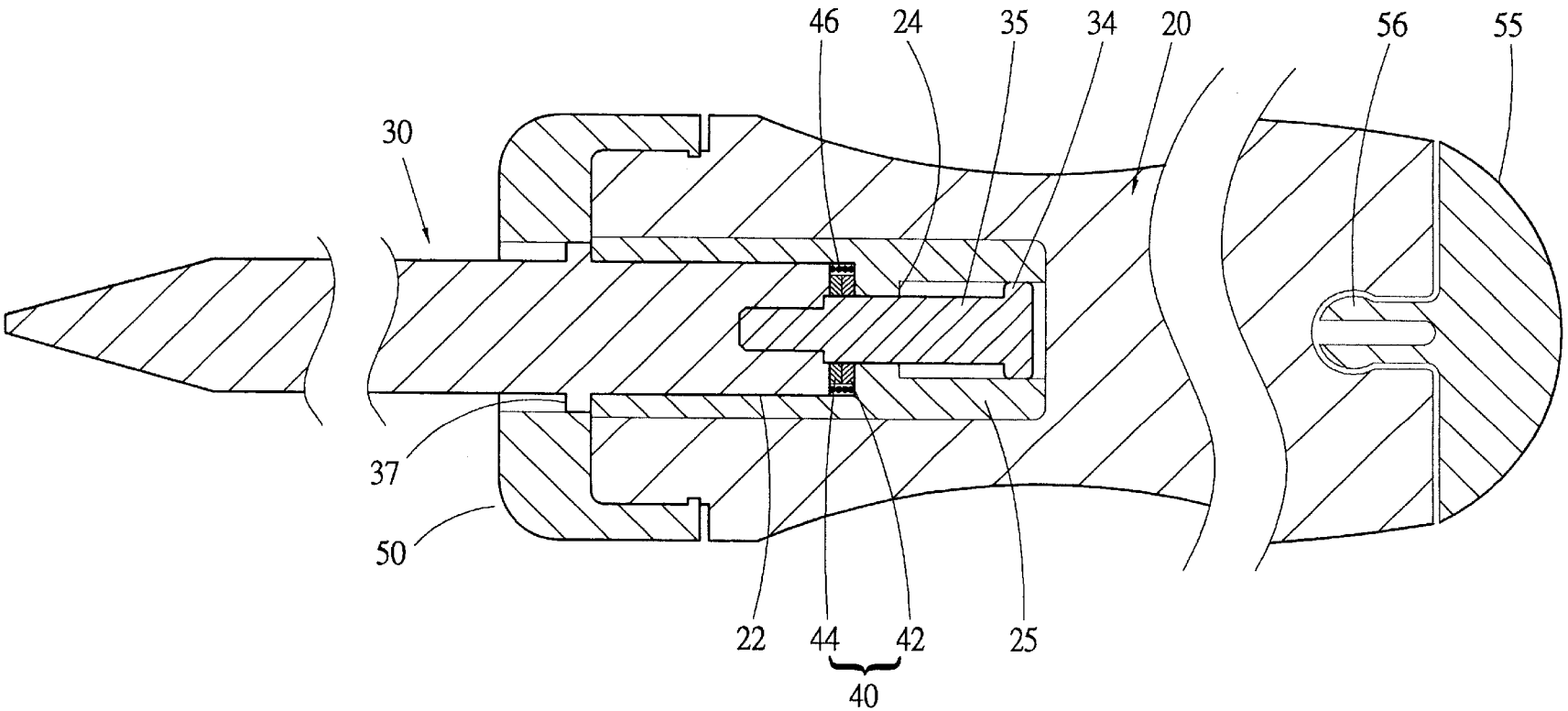
FIG. 7 shows another using state of the present invention, in which the clutch mechanism is engaged.

In the case that the screw is in a tightened state, the resistance of the screw is great so that the above operation is not suitable for turning the stem. At this time, the user can press the handle 20 to make the stem 30 move into the slide way 22 as shown in FIG. 7. At this time, the two toothed bodies 42, 44 are engaged with each other and the resilient member 46 is compressed. After the toothed bodies are engaged, the clutch mechanism 40 is in an engaged state to provide transmission effect. Under such circumstance, when turning the handle 20, via the clutch mechanism, the stem 30 is rotated to screw a tightened screw.

In the operation state of FIG. 7, after the user's hand turns the handle 20 in a direction (such as clockwise) by a certain angle, the user can release the handle from the pressing force, making the resilient member 46 push the handle upward. At this time, the toothed bodies of the clutch mechanism 40 are disengaged and restored to the non-transmission state of FIG. 2. Under such circumstance, the user can turn the handle in a reverse direction (such as counterclockwise) with the stem 30 remaining unmoved. After the handle is turned back by a certain angle, the handle is pressed into a state as shown in FIG. 7. At this time, the clutch mechanism is again in an engaged state, whereby by means of turning the handle, the stem is driven and rotated. Accordingly, the clutch mechanism is repeatedly switched between the disengaged state and engaged state to keep screwing the screw.

In addition, with respect to tightened screw, the present invent ion provides another operation measure. The present invent ion further includes a rotary disc 55 having a shaft section 56. The shaft section 56 is pivotally and freely rotatably connected with the rear end of the handle 20. In the state of FIG. 7, after the hand turns the handle and the stem in a direction by a certain angular displacement, the user can attach his/her palm to the rotary disc 55 and turn his/her hand in a reverse direction. During the back turn, the hand keeps pressing the handle, making the clutch mechanism 40 keep in the engaged state with the handle and stem remaining unmoved. After the hand turns back by a certain angle, the handle is again forcedly turned to drive the stem. By means of such measure, when screwing the screw, it is unnecessary to disengage the clutch mechanism 40 so that it is quicker and more convenient to perform the operation.

Figure 8:
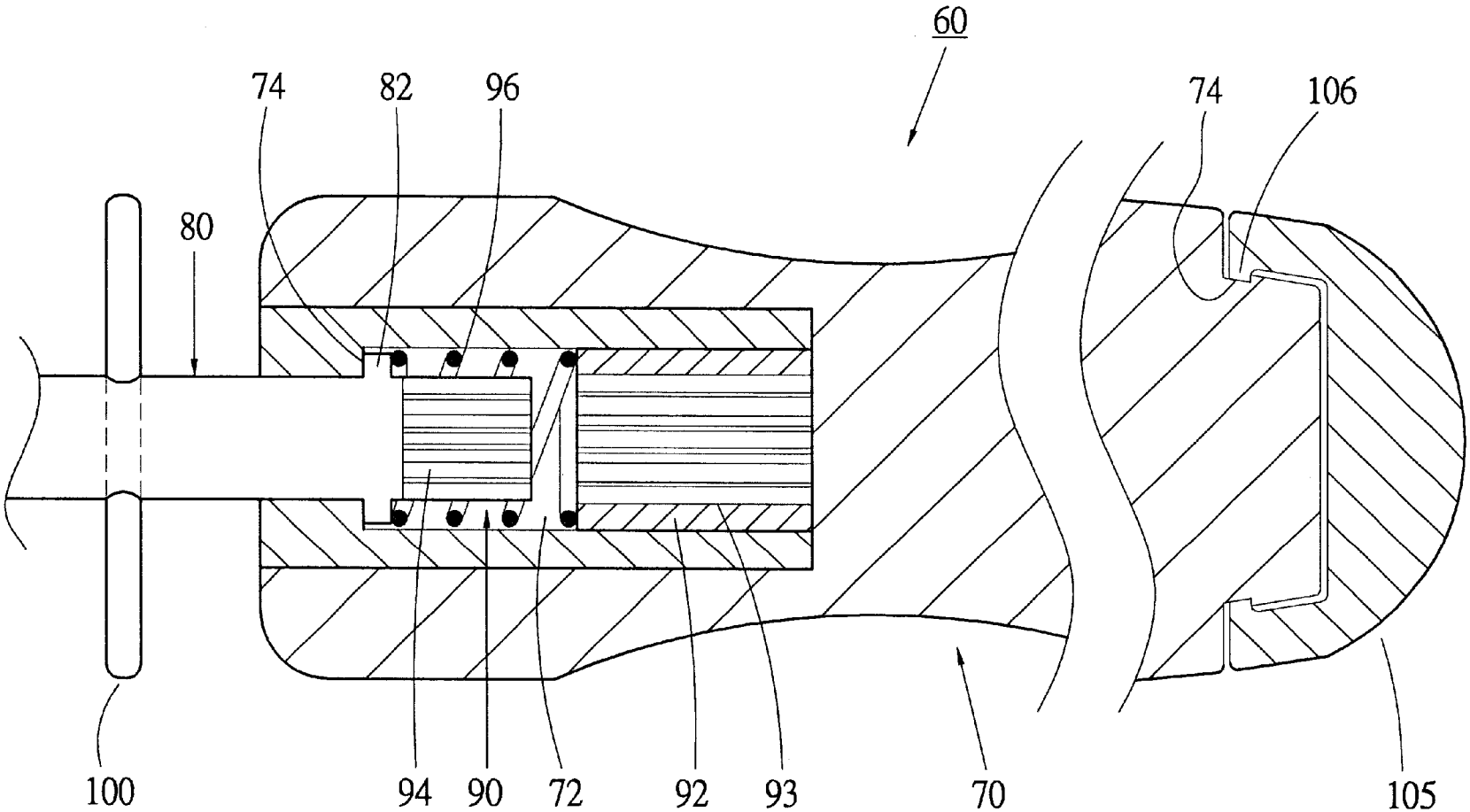
FIG. 8 is a longitudinal sectional view of another embodiment of the present invention.
Figure 9:
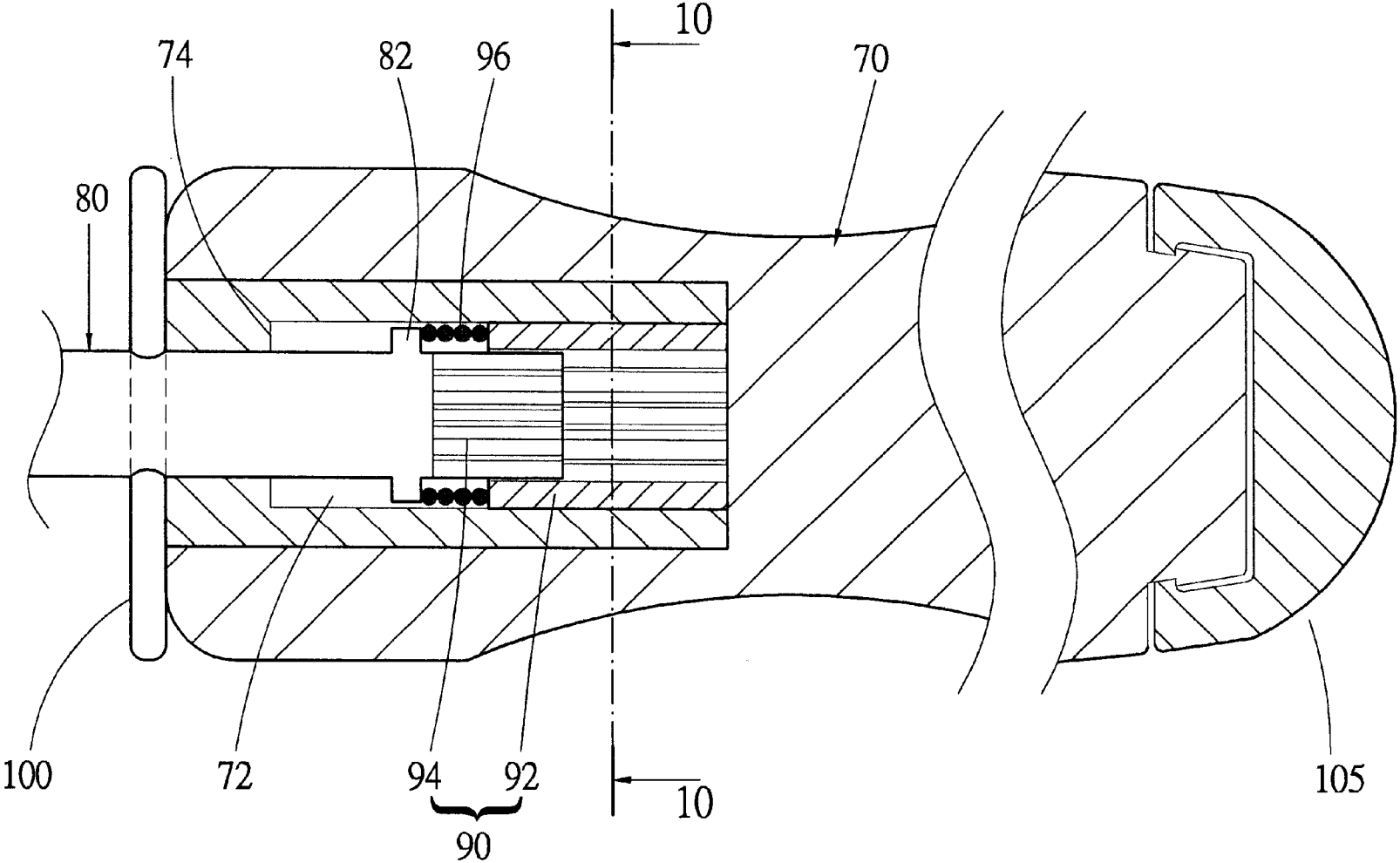
FIG. 9 shows that the clutch mechanism in FIG. 8 is engaged.

FIGS. 8 and 9 show another embodiment of the present invention. The screwdriver 60 includes components and connection relationships identical to those of the first embodiment. The stem 80 is slidably fitted in the slide way 72 of the handle 70. The rear end of the stem is formed with projecting stop portion 82 abutting against a shouldered locating section 74 in the slide way, whereby the handle is prevented from detaching from the slide way. The clutch mechanism 90 is also connected between the stem 80 and the handle 70 for changing the driving relationship between the stem and the handle. The rotary member 100 is connected with the stem. The rotary disc 105 is pivotally disposed at rear end of the handle.

Figure 10:
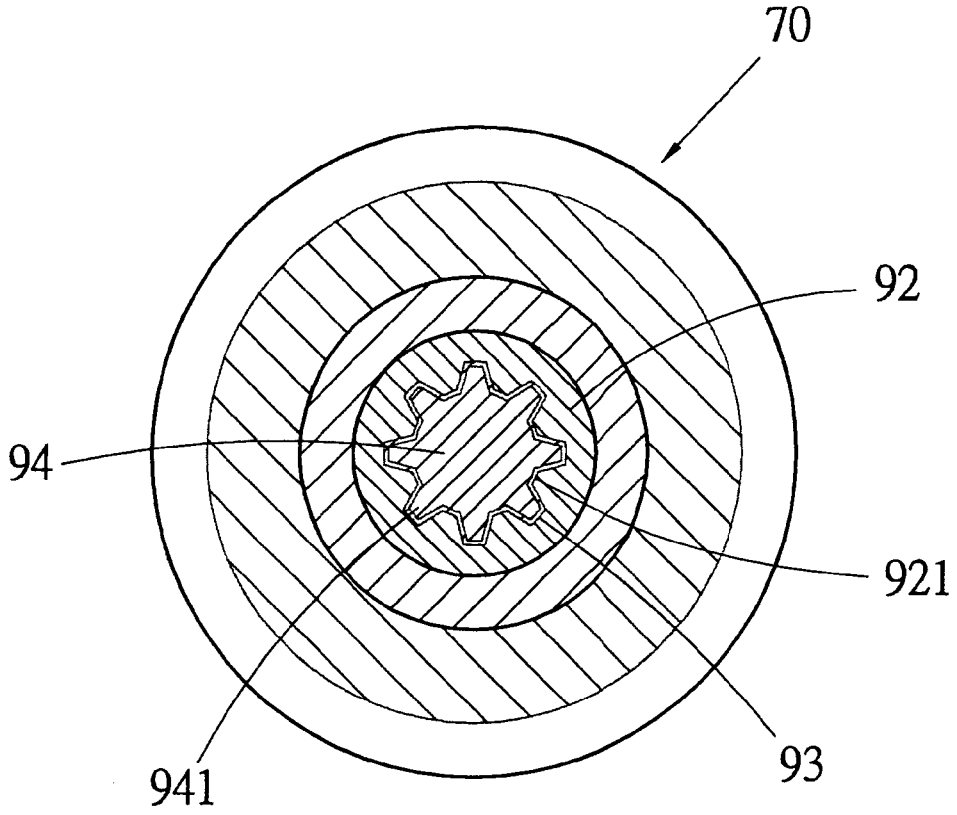
FIG. 10 is a sectional view taken along line 10—10 of FIG. 9.

This embodiment is different from the above embodiment in that the second toothed body 94 of the clutch mechanism 90 is integrally formed on or fixedly connected with the rear end of the stem 80, and it has multiple teeth. Referring to FIG. 10, the teeth 941 are linear teeth annularly arranged on outer circumference of the stem. The axes of the teeth are parallel to the axis of the stem. The first toothed body 92 is integrally formed in or fixedly disposed in the slide way 72, and it is formed with an inner hole 93. The inner circumference of the inner hole is formed with several annularly arranged teeth 921 which are also linear teeth. The axes of the teeth 921 are parallel to the axis of the stem. One end of the resilient member 96 abuts against the stem 80, while the other end is located in the slide way 72. When not suffering external force, the two toothed bodies keep in a disengaged state.

The rotary member 100 is a pin transversely inserted through the stem 80 or integrally formed on the stem.

The rotary disc 105 has an annular flange 106 at front end rotatably latched in an annular groove 74 formed on rear end of the handle.

In the state of FIG. 8, the clutch mechanism 90 is in a non-transmission state and is applicable to a screw in loosened state. A user can shift the rotary member 100 with finger(s) to drive and rotate the stem 80.

When pressing the handle 70 to make the stem 80 move inward, the second toothed body 94 is fitted into the first toothed body 92 to make the teeth 921, 941 engaged with each other as shown in FIGS. 9 and 10, the clutch mechanism 90 is in a transmission state. The user can turn the handle to drive the stem for screwing a screw in a tightened state. The operation is identical to the above embodiment and will not be further described.

In conclusion, the present invention provides a screwdriver with a clutch mechanism instead of the ratchet structure. In accordance with the loosened and tightened states of the screw, the operation modes of the screwdriver can be changed to enhance the convenience in operation.

What is claimed is:

1. A screwdriver with changeable operation modes, comprising:

a handle; a slide way being formed in the handle and passing through a front end of the handle, an axis of the slide way being parallel to an axis of the handle;

a stem, a rear end of the stem being fitted in the slide way and slidable along the slide way without detaching therefrom, a front end of the stem extending out from the handle;

a clutch mechanism connected between the stem and the handle, in normal state, the clutch mechanism being in a non-transmission state, whereby the handle cannot drive the stem and the stem can freely rotate within the handle, when the stem is moved into the handle, the clutch mechanism being in a transmission state, whereby by means of turning the handle, the stem is driven; and a rotary member connected with a section of the stem protruding from the handle for a user's hand to rotate;

the rotary member is a pin connected with the stem;

whereby when the clutch mechanism is in the non-transmission state, the user can turn the rotary member to rotate the stem and when the clutch mechanism is in the transmission state, the user can turn the handle to drive and rotate the stem.

2. The screwdriver as claimed in claim 1, wherein the clutch mechanism includes a first toothed body, a second toothed body and a resilient member, the first toothed body having multiple teeth and being fixedly disposed in the slide way; the second toothed body having multiple teeth and being fixedly disposed at rear end of the stem; the resilient member being disposed in the slide way, when not suffering external force, the resilient member resiliently keeping the stem sliding outward from the handle, making the two toothed bodies disengaged from each other to form a non-transmission state, when the stem is forcedly moved into the slide way, the two toothed bodies being engaged with each other to form a transmission state of the clutch mechanism.

3. The screwdriver as claimed in claim 2, wherein the toothed bodies are annular bodies, the end faces of the toothed bodies facing each other being formed with multiple annularly arranged teeth.

4. The screwdriver as claimed in claim 2, wherein the end face of the first toothed body facing the second toothed body is recessed to form an inner hole, an axis of the inner hole being parallel to the axis of the stem, the inner circumference of the inner hole being formed with multiple annularly arranged linear teeth at equal intervals, the axis of the teeth being parallel to the axis of the stem, whereby the second toothed body can be fitted into the inner hole of the first toothed body to make the teeth engaged with each other.

5. The screwdriver as claimed in claim 1, wherein the rotary member is a fitting ring formed with a central engaging hole, the rotary member being pivotally and freely rotatably disposed at front end of the handle, the front end of the stem extending out from the engaging hole and being slidable in the engaging hole, the body of the stem being engaged in the engaging hole, whereby the rotary member can drive the stem to rotate.

6. The screwdriver as claimed in claim 5, wherein the cross-sections of the stem and the engaging hole are polygonal.

7. The screwdriver as claimed in claim 5, wherein the circumference of the engaging hole is formed with a predetermined number of dents and the circumference of the body of the stem is formed with a predetermined number of projecting sections for engaging with the dents.

8. The screwdriver as claimed in claim 1, wherein an inner wall face of the slide way is formed with a locating section and the stem has a stop portion stoppable by the locating section, whereby the stem is prevented from detaching from the slide way.

9. The screwdriver as claimed in claim 8, wherein the stem further includes a restricting member fixedly connected with rear end of the stem and positioned in the slide way, the stop portion being formed on the restricting member.

10. The screwdriver as claimed in claim 8, wherein the stop portion is formed on the circumference of rear end of the stem.

11. The screwdriver as claimed in claim 2, wherein one end of the resilient member abuts against a predetermined portion in the slide way, while the other end of the resilient member abuts against rear end of the stem.

12. The screwdriver as claimed in claim 2, wherein one end of the resilient member abuts against a predetermined portion in the slide way, while the other end of the resilient member abuts against the second toothed body.

13. The screwdriver as claimed in claim 4, wherein one end of the resilient member abuts against the first toothed body, while the other end of the resilient member abuts against the stem.

14. The screwdriver as claimed in claim 1, further comprising a rotary disc pivotally and freely rotatably disposed at rear end of the handle.

15. The screwdriver as claimed in claim 14, wherein the rotary disc has a central shaft section pivotally disposed in the handle.

16. The screwdriver as claimed in claim 14, wherein the front end of the rotary disc is formed with an annular flange and the circumference of rear end of the handle is formed with an annular groove in which the flange is latched.

17. The screwdriver as claimed in claim 1, wherein the handle further includes a hard tubular member axially embedded in the handle from front end thereof, the slide way being formed in the tubular member.

18. The screwdriver with changeable operation modes, comprising:

a handle; a slide way being formed in the handle and passing through a front end of the handle, an axis of the slide way being parallel to an axis of the handle;

a stem, a rear end of the stem being fitted in the slide way and slidable along the slide way without detaching therefrom, a front end of the stem extending out from the handle; and a clutch mechanism connected between the stem and the handle, in normal state, the clutch mechanism being in a non-transmission state, whereby the handle cannot drive the stem and the stem can freely, rotate within the handle, when the stem is moved into the handle, the clutch mechanism being in a transmission state, whereby by means of turning the handle, the stem is driven;

whereby when the clutch mechanism is in the non-transmission state, the user can turn the stem and when the clutch mechanism is in the transmission state, the user can turn the handle to drive and rotate the stem;

the clutch mechanism includes a first toothed body, a second toothed body and a resilient member, the first toothed body having multiple teeth and being fixedly disposed in the slide way; the second toothed body having multiple teeth and being fixedly disposed at rear end of the stem; the resilient member being disposed in the slide way, when not suffering external force, the resilient member resiliently keeping the stem sliding outward from the handle, making the two toothed bodies disengaged from each other to form a non-transmission state, when the stem is forcedly moved into the slide way, the two toothed bodies being engaged with each other to form a transmission state of the clutch mechanism.

19. The screwdriver as claimed in claim 18, further includes a rotary member connected with a section of the stem protruding from the handle, when the clutch mechanism is in the non-transmission state, the user can turn the rotary member to rotate the stem.

* * * * *